US008074428B2

(12) United States Patent
Hoppe et al.

(10) Patent No.: US 8,074,428 B2
(45) Date of Patent: Dec. 13, 2011

(54) METHOD OF, AND APPARATUS FOR, PRODUCING BAG PACKS

(75) Inventors: Reinhard Hoppe, Tespe (DE); Peter Krause, Visselhövede (DE)

(73) Assignee: Focke & Co. (GmbH & Co. KG), Verden (DE)

( * ) Notice: Subject to any disclaimer, the term of this patent is extended or adjusted under 35 U.S.C. 154(b) by 309 days.

(21) Appl. No.: 12/402,125

(22) Filed: Mar. 11, 2009

(65) Prior Publication Data

US 2010/0058714 A1 Mar. 11, 2010

(30) Foreign Application Priority Data

Mar. 19, 2008 (DE) ..... 10 2008 015 082

(51) Int. Cl.
*B65B 35/54* (2006.01)
*B65B 63/02* (2006.01)

(52) U.S. Cl. ..... 53/438; 53/436; 53/439; 53/469; 53/523; 53/529; 53/530

(58) Field of Classification Search ..... 53/436, 53/438, 439, 469, 523, 529, 530; 131/111, 131/112, 115, 907
See application file for complete search history.

(56) References Cited

U.S. PATENT DOCUMENTS 3,088,499 A * 5/1963 Rieger ..... 141/81
4,330,976 A * 5/1982 Blackall et al. ..... 53/151
4,519,179 A * 5/1985 Meier ..... 53/236
4,600,021 A * 7/1986 Mattei ..... 131/110
4,607,479 A * 8/1986 Linden ..... 53/530
4,696,146 A * 9/1987 Esch et al. ..... 53/529
4,703,765 A * 11/1987 Paules et al. ..... 131/112
4,840,240 A * 6/1989 Toyoda et al. ..... 177/25.18
4,844,190 A * 7/1989 Mikami et al. ..... 177/25.18
4,866,912 A * 9/1989 Deutsch ..... 53/449
5,050,370 A * 9/1991 Stederoth ..... 53/502
5,174,088 A * 12/1992 Focke et al. ..... 53/431
5,340,269 A * 8/1994 Caridis et al. ..... 414/800
5,401,156 A * 3/1995 Anderson ..... 425/147
5,425,215 A * 6/1995 Lewis et al. ..... 53/170
5,459,982 A 10/1995 Long
5,465,554 A * 11/1995 Lewis et al. ..... 53/438

(Continued)

FOREIGN PATENT DOCUMENTS

DE 1034092 12/1958

(Continued)

OTHER PUBLICATIONS

German Search Report.

*Primary Examiner* — Lindsay Low
*Assistant Examiner* — Gloria R Weeks
(74) *Attorney, Agent, or Firm* — Laurence P. Colton; Smith Risley Tempel Santos LLC

(57) ABSTRACT

For the production and filling of (sheet-material) bags (10) with one tobacco portion (18) each, a plurality of bags (10) are preferably made available in the region of a filling station (20). The latter is located in the vicinity of a pressing station (19), which is supplied with the tobacco portions (18). In the region of the pressing station (19) or in a pressing chamber (35), each tobacco portion (18) is compressed in the vertical direction on a horizontal rest, namely on a platform (39), and in addition preferably compressed by a pressing crosspiece (42) in the horizontal direction. The tobacco portion (18) thus formed is introduced into the bag (10).

16 Claims, 14 Drawing Sheets

U.S. PATENT DOCUMENTS

| | | | | |
|---|---|---|---|---|
| 5,709,069 | A * | 1/1998 | Cronauer | 53/459 |
| 6,044,624 | A * | 4/2000 | Focke et al. | 53/438 |
| 6,105,637 | A * | 8/2000 | VerMehren | 141/248 |
| 6,301,859 | B1 * | 10/2001 | Nakamura et al. | 53/373.7 |
| 6,474,050 | B1 * | 11/2002 | Tetenborg | 53/570 |
| 7,257,935 | B1 * | 8/2007 | Wehrmann | 53/469 |
| 7,752,826 | B2 * | 7/2010 | Yamaguchi et al. | 53/55 |
| 7,861,498 | B2 * | 1/2011 | Sugioka et al. | 53/502 |
| 2009/0199512 | A1 * | 8/2009 | Sala | 53/448 |
| 2010/0223886 | A1 * | 9/2010 | Sugioka et al. | 53/248 |

FOREIGN PATENT DOCUMENTS

| | | | |
|---|---|---|---|
| DE | 3409263 | A1 | 9/1985 |
| DE | 197 14 245 | A1 | 8/1998 |

* cited by examiner

*Fig. 14*
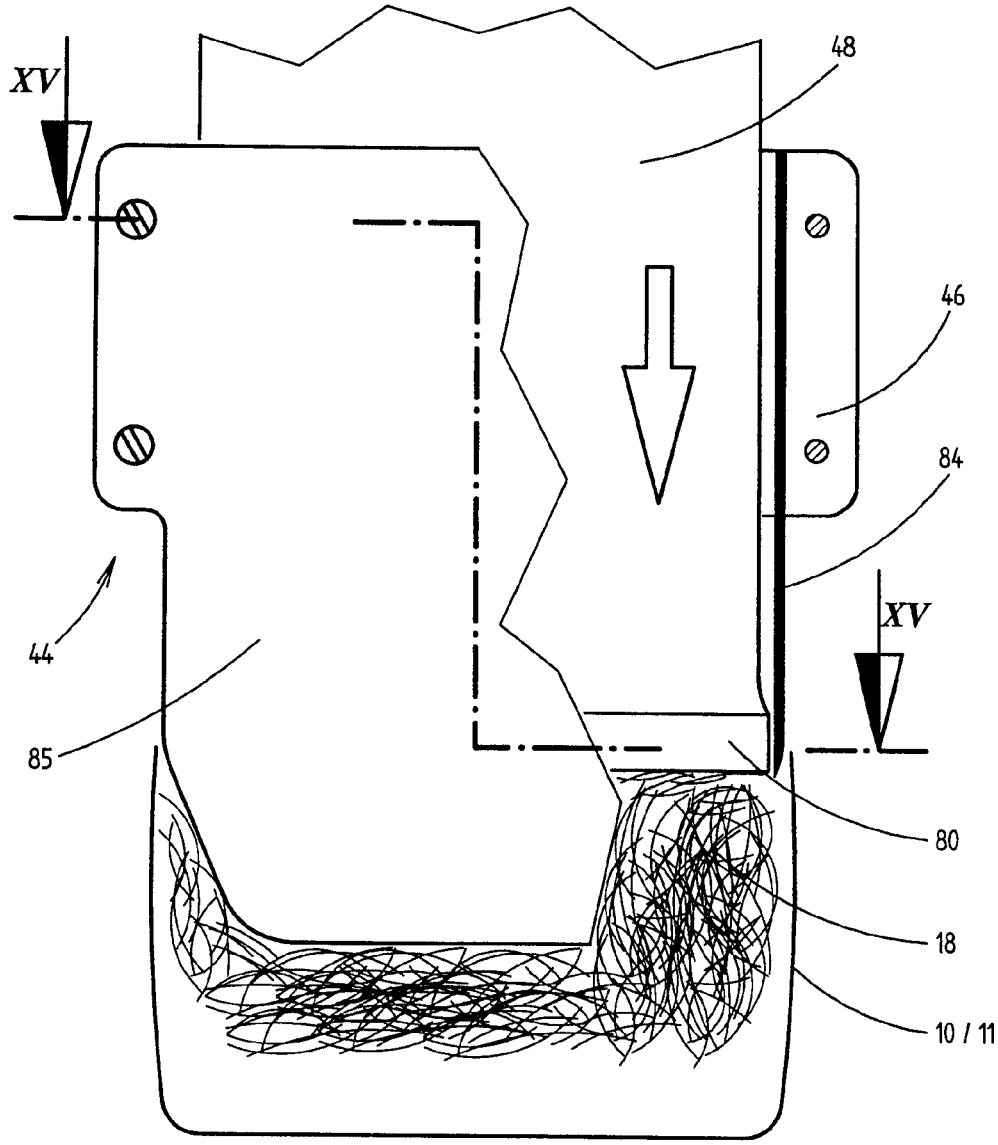
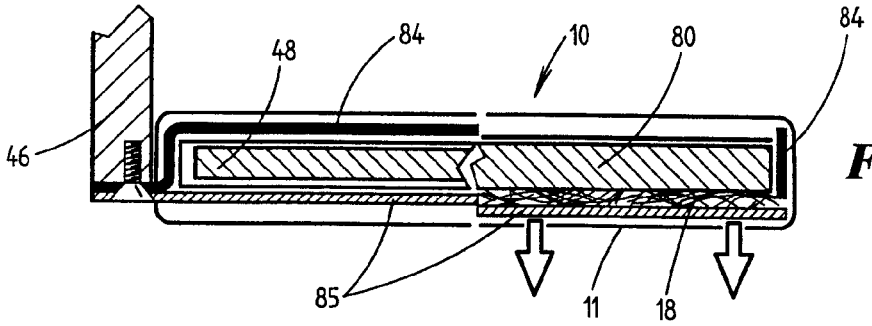
*Fig. 15*

METHOD OF, AND APPARATUS FOR, PRODUCING BAG PACKS

STATEMENT OF RELATED APPLICATIONS

This patent application claims the benefit under 35 USC 119 of German Patent Application Number DE 10 2008 015 082.7 having a filing date of 19 Mar. 2008, which is incorporated herein in its entirety by this reference.

BACKGROUND OF THE INVENTION

1. Technical Field

The invention relates to a method of introducing portions of formable contents into a pack, in particular for introducing tobacco portions into a sheet-material bag, the portion being compressed and then introduced into the bag. The invention also relates to apparatuses for implementing the method.

2. Prior Art

In the production of (sheet-material) bags containing tobacco portions, it is known for the precisely metered portion to be pressed to form a more or less cuboidal or bar-like structure, which is introduced into an open pocket of the bag from above. The bag is then closed, in particular by means of a fold-over flap and closure means such as tape (DE 197 14 245).

BRIEF SUMMARY OF THE INVENTION

It is an object of the invention to improve the production and filling of such bags, in particular in respect of production capacity. The intention is also for the compressing operation to be developed.

In order to achieve this object, the method according to the invention is characterized by the following features:

a) the portion is pressed on a fixed support by means of a movable pressing mechanism,
b) the portion is compressed transversely between the pressing mechanisms in the pressing position by a third, transversely movable pressing mechanism,
c) the compressed portion is pushed out of the region of the pressing mechanisms and transferred to an intermediate conveyor with a portion pocket, the pressing position being maintained in the process,
d) the intermediate conveyor or the portion pocket transports the portion into a position above the bag and/or a pocket which is open in the upward direction,
e) by virtue of downwardly directed movement, the portion is pushed out of the intermediate conveyor or out of the portion pocket and into the bag and/or into the pocket.

The special feature of this method resides in the fact that the compressed portion is received by a separate portion conveyor and fed to a filling station for introduction into the bag. During transportation of the portion, and during the introduction operation, the pressing mechanisms are free for receiving the next portion. This increases capacity.

The pressing mechanisms, in particular a platform and a movable, pivotable pressing plate, are positioned in an obliquely directed plane—at an acute angle to a vertical plane. The movement path of the portion pocket also constitutes a special feature, that is to say running along a rectilinear, obliquely directed movement path following the pressing station and then, with the pocket being erected in the process, along an arcuate and, finally, downwardly directed path.

A special feature specific to the method and/or the apparatus resides in the fact that the mechanisms concerned with the compressing operation and with transporting the compressed portions, that is to say, in particular, the pressing mechanisms and the portion pockets, have elastically compliant walls and/or are activated for vibration. The pressing plates and walls of the portion pocket are mounted resiliently or are themselves of resilient design. This results in a better, homogeneous structure of the pressed portion and in uniform density distribution. Furthermore, it is easier for the compressed portion to be displaced and/or pushed out.

BRIEF DESCRIPTION OF THE DRAWINGS

Further details and features of the method and of the apparatus will be explained more specifically hereinbelow with reference to exemplary embodiments illustrated in the drawings, in which:

FIG. 14 shows the filling station or a detail along section or viewing plane XIV-XIV from FIG. 13.

FIG. 15 shows the detail according to FIG. 14 in cross section along section plane XV-XV in FIG. 14.

DETAILED DESCRIPTION OF PREFERRED EMBODIMENTS

Figure 2:
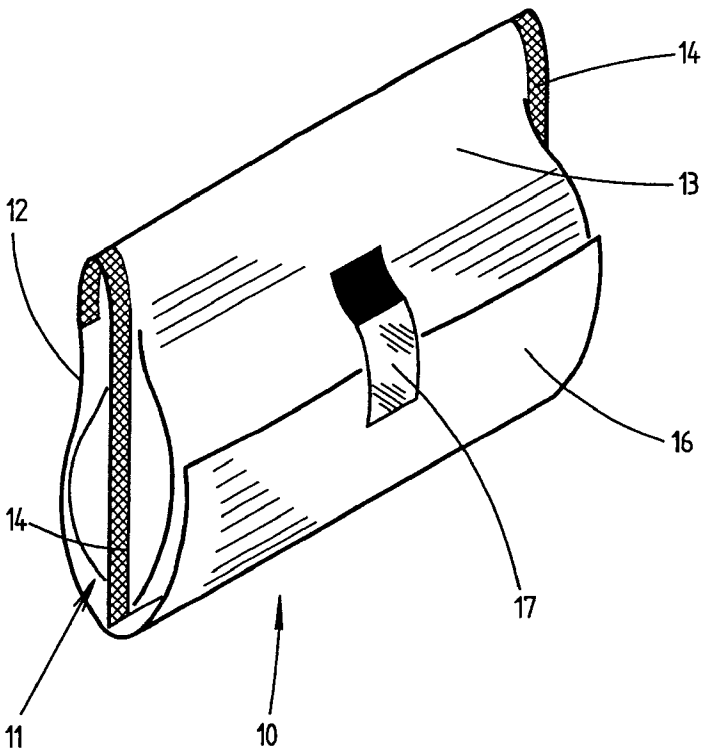
FIG. 2 shows a likewise perspective illustration of the bag according to FIG. 1 once it has been filled and closed.
Figure 1:
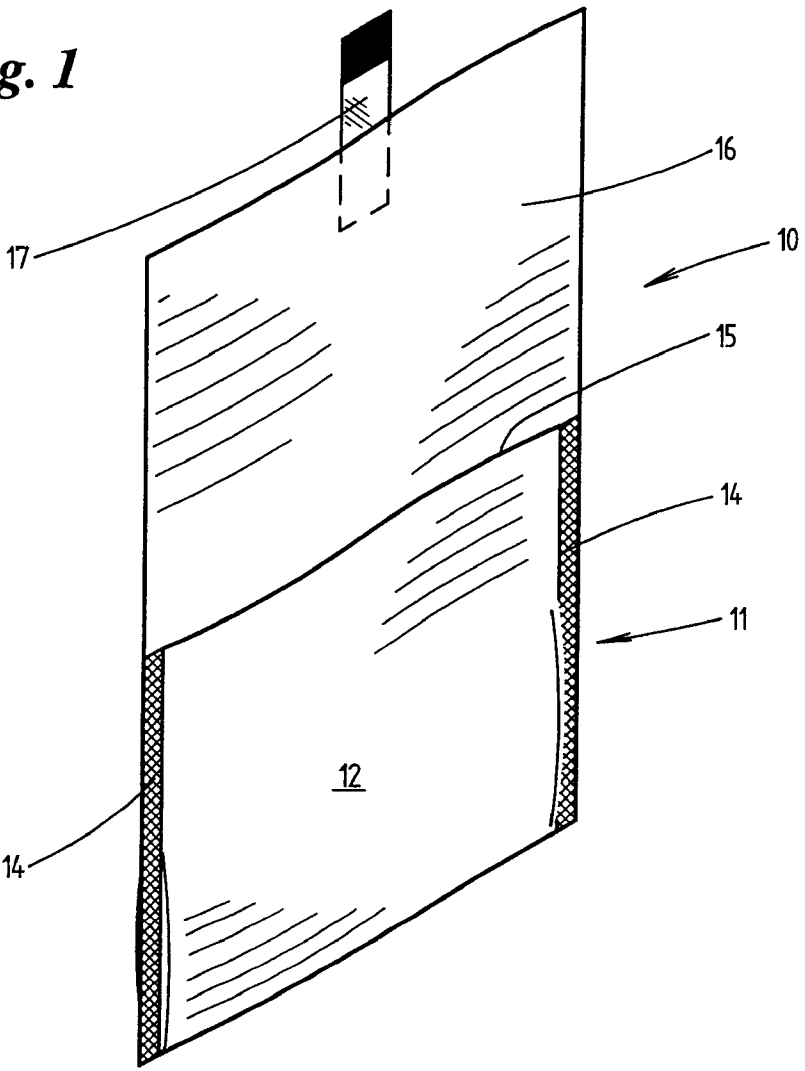
FIG. 1 shows a perspective illustration of a sheet-material (tobacco) bag in the open position.

The drawings deal with the production and, in particular, filling of bags 10 made of sheet material. The bag 10 comprises a single-piece blank which is folded over to form a pocket 11. The latter comprises a front wall 12 and a rear wall 13. Borders are connected to one another by side seams 14 to form the pocket 11, with an open side as pocket opening 15. The rear wall 13 is provided with an extension which forms a fold-over flap 16. Once the pocket 11 has been filled and, if appropriate, the pocket opening 15 has been closed, the fold-over flap 16 is folded around the pocket 11 and fixed in a releasable manner on the rear wall 13 by means of tape 17 with an adhesive-free grip tab.

Figure 9:
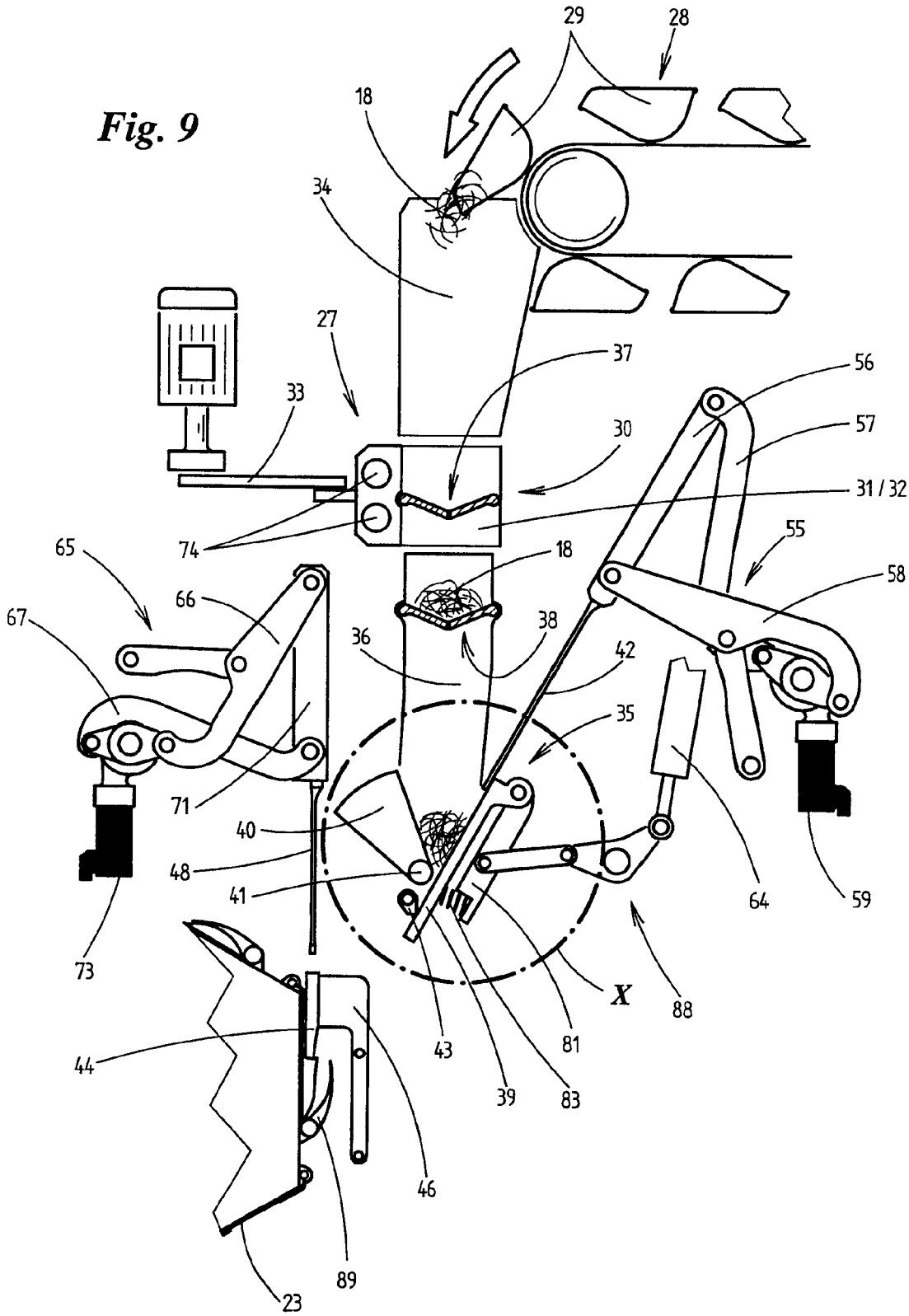
FIG. 9 shows the detail according to FIG. 4 in a side view, partly in vertical section along section plane IX-IX from FIG. 8.

The contents which are to be introduced into the bag 10 consist of compressible material, in this case a portion of cut tobacco, that is to say a tobacco portion 18. Prior to being introduced into the pocket 11, this tobacco portion is pressed into a compressed, in particular plate-like or bar-like, configuration. For this purpose, the precisely measured-out tobacco portions 18 coming from a metering station are fed to a first processing station, namely to a formatting or pressing station 19. Following the pressing station 19, the tobacco portions 18 formed are transferred to a filling station 20, in which the tobacco portions 18 are introduced into the bag 10 via the free pocket opening 16. As is shown in FIG. 9, the stations 19, 20 are arranged one beside the other in a vertically offset manner.

Figure 3:
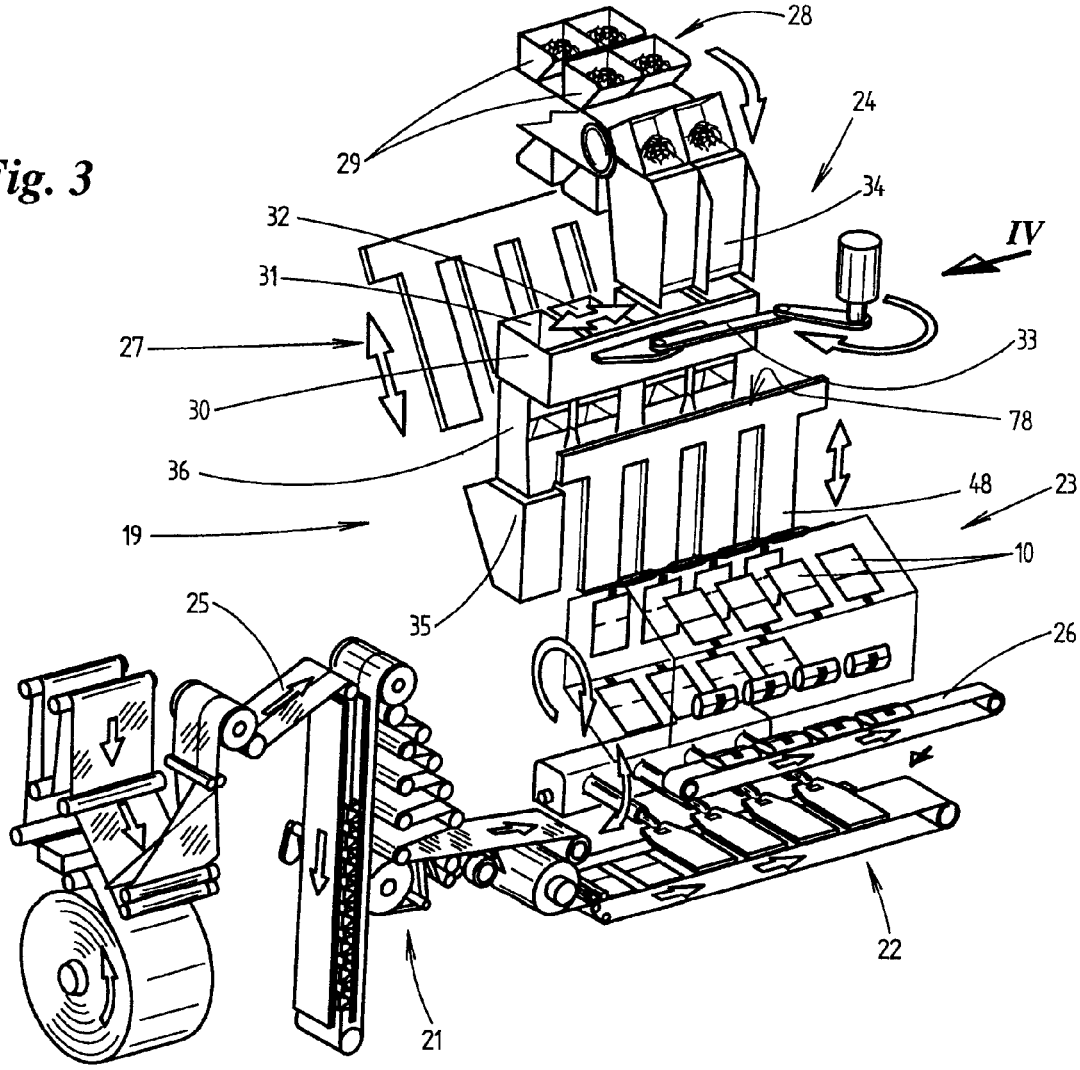
FIG. 3 shows an overall schematic illustration, in perspective, of an arrangement for producing and filling (tobacco) bags.
Figure 4:
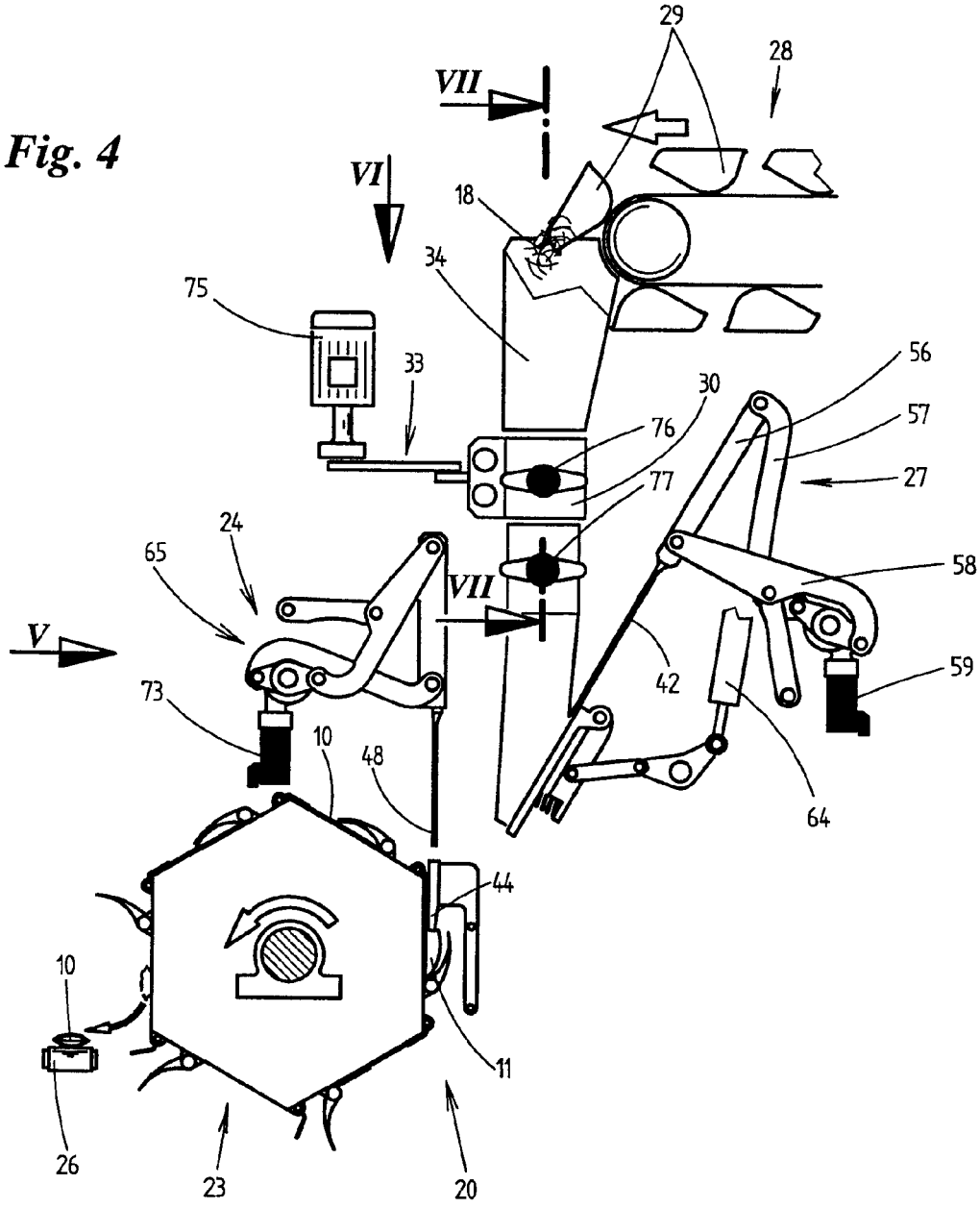
FIG. 4 shows a filling unit as part of the arrangement according to FIG. 3 in a side view corresponding to arrow IV from FIG. 3.
Figure 5:
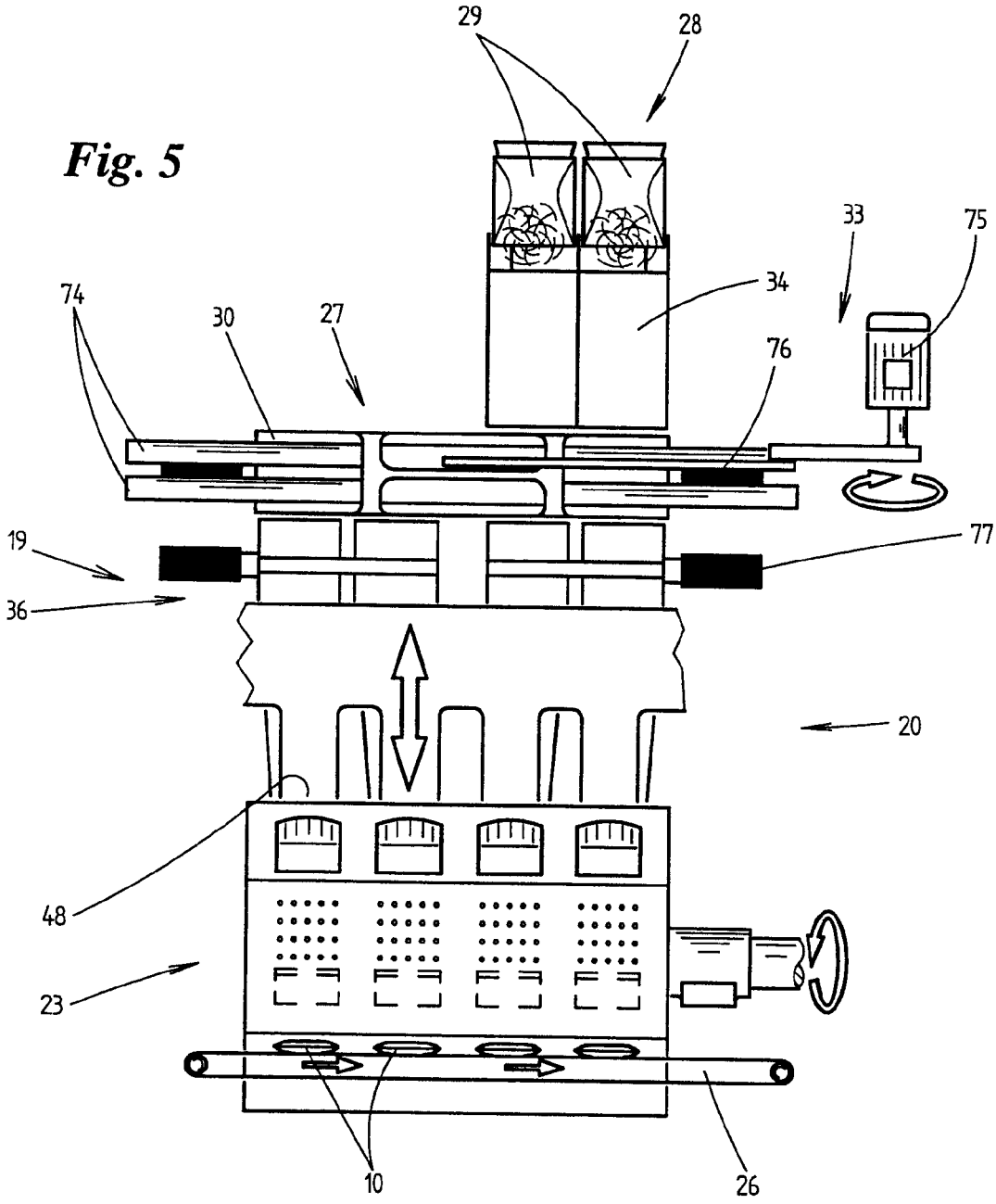
FIG. 5 shows the detail according to FIG. 4 in a side view corresponding to arrow V in FIG. 4.
Figure 6:
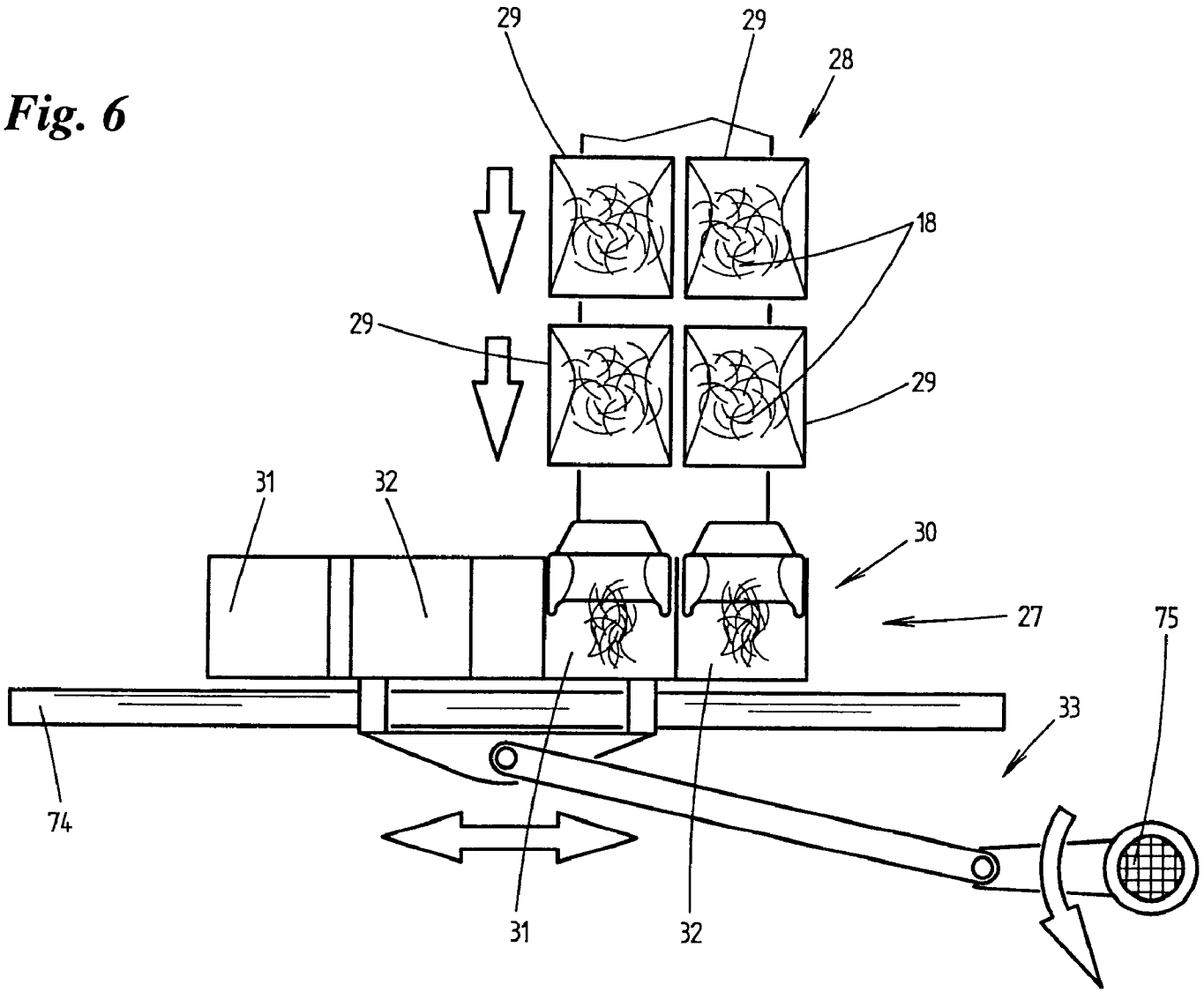
FIG. 6 shows, on an enlarged scale, the detail according to FIG. 4 in plan view, corresponding to arrow VI in FIG. 4.
Figure 7:
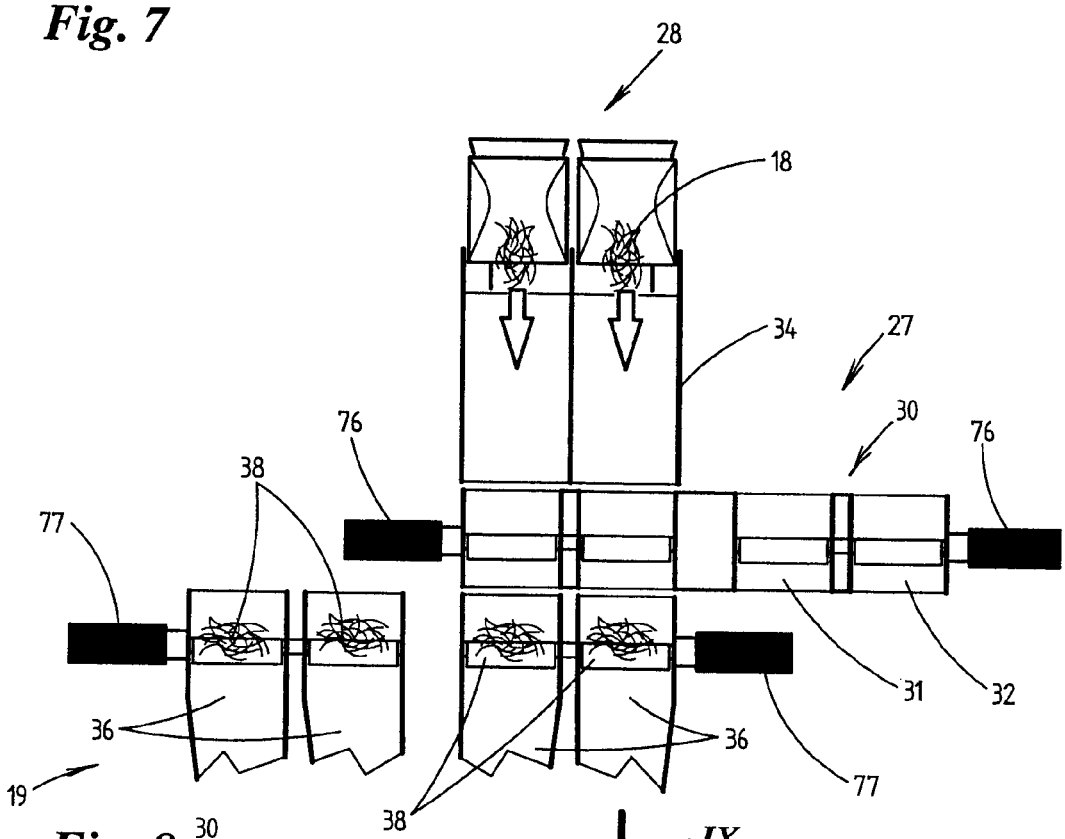
FIG. 7 shows a sub-region of the unit according to FIG. 4 in a vertical section along section plane VII-VII from FIG. 4.
Figure 8:
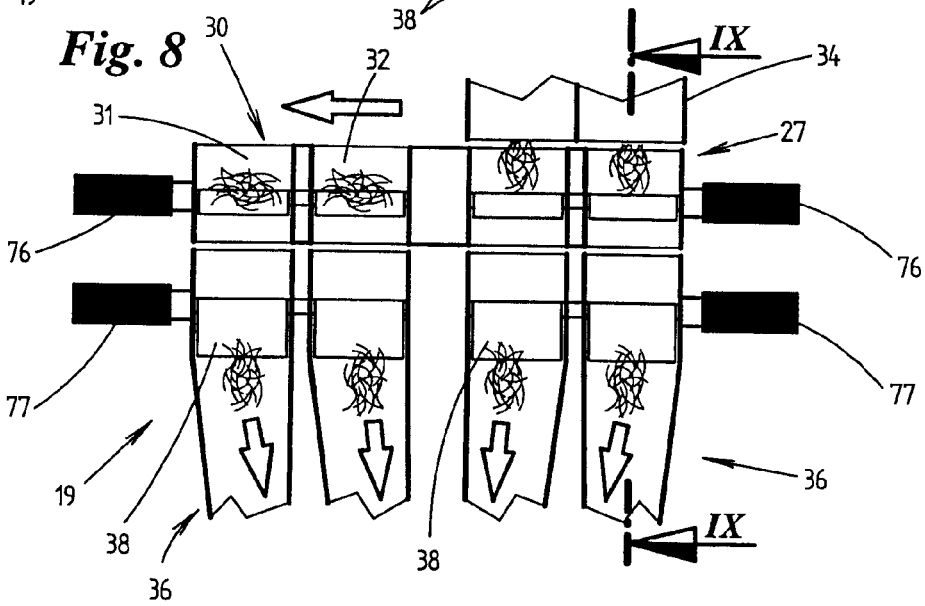
FIG. 8 shows the detail according to FIG. 7 with mechanisms in different positions.

The pressing station 19 and/or filling station 20 are/is preferably a constituent part of an arrangement for producing and filling the bags 10. According to FIG. 3, this arrangement has a compact construction and preferably comprises a production unit 21 for producing the bags 10, a transfer unit 22, a bag turret 23, and a filling unit 24. In the production unit 21, the bags 10 are produced from a continuous sheet-material web 25. The individual bags 10 are fed to the transfer unit 22. A plurality of bags 10, in particular four bags 10, are preferably made available in the region of the transfer unit 22 and transferred simultaneously to the further-processing mechanism, namely to the bag turret 23. In the region of the latter, the bags 10 are processed further and, in particular, filled and then closed. Completed bags 10 are transferred from the bag turret 23 to a removal conveyor 26.

The arrangement is constructed such that the compact production unit 21 and the transfer unit 22 are arranged one beside the other, but the rest of the units are arranged essentially above the transfer unit 22 and/or the bag turret 23. The arrangement achieves a high capacity in that a plurality of bags 10, in the present example four bags 10, are filled simultaneously.

A special feature of the filling unit 24 is constituted by a collecting subassembly 27 for the tobacco portions 18. The collecting subassembly 27 operates such that a number of tobacco portions 18 which corresponds to the number of bags 10 which are to be filled simultaneously is made available for simultaneous transfer, to be precise irrespective of the number of tobacco portions 18 fed. In the present example, the tobacco portions 18 are fed by a tobacco conveyor, to be precise by a bucket chain 28 with two buckets 29 arranged one beside the other in pairs for in each case one tobacco portion 18. The buckets 29 are emptied by virtue of the bucket chain 28 being deflected, in which case the tobacco portions 18—in the present case two portions simultaneously—are discharged downwards.

The tobacco portions 18 pass into a collector and distributor, which is designed as a transverse slide 30. The latter has a plurality of chambers 31, 32 as holders for a respective portion 18. The transverse slide 30 can be moved back and forth, with the chambers 31, 32, transversely to the feed direction of the tobacco portions 18, to be precise by a drive, namely a crank drive 33. The transverse slide 30 can be moved synchronously via the crank drive 33 in dependence on the feed of tobacco portions and the further processing of the same. In each case two adjacent chambers 31, 32 are located in an accommodating position beneath a (double) hopper 34, by means of which the portions 18 discharged from the buckets 29 are directed into a respective chamber 31, 32 of the transverse slide 30. The movement of the transverse slide 30 is controlled such that first of all first chambers 31, 32 and then second chambers 31, 32 are filled, in which case all the chambers of the transverse slide 30 are filled with a respective tobacco portion 18. This collecting unit is thus ready for transferring a number of portions 18 which corresponds to the processing in the region of the filling unit 24.

The tobacco portions 18 are transferred simultaneously from the transverse slide 30 to a processing station which follows, that is to say is arranged beneath the transverse slide 30, in the present case to the pressing station 19. The latter comprises a number of adjacent pressing chambers 35 which corresponds to the number of simultaneously processed tobacco portions 18. Each of these pressing chambers 35 is provided with a delimited shaft 36, which forms a connection and/or a guide channel between the transverse slide 30 and pressing chamber 35. The shaft 36 is connected to the associated pressing chamber 35. The transverse slide 30 can be positioned above the (four) shafts 36 such that the tobacco portions 18 are transferred from the chambers 31, 32 to in each case one associated shaft 36, that is to say a shaft arranged precisely beneath a chamber 31, 32.

The transfer of tobacco portions 18 to respectively following mechanisms can be controlled by movable holders. Each chamber 31, 32 of the transverse slide 30 has a movable restraining mechanism for the tobacco portions 18, in the present case shutters 37, which preferably comprise two pivotable sub-shutters. In the blocking or accommodating position (FIG. 9), the two sub-shutters abut by way of their peripheral edges to give a closed shutter 37 which blocks through-passage. This shutter is funnel-like in profile, with a downwardly oriented depression for accommodating the tobacco portion 18 in a centered manner. The sub-shutters of the shutter 37, which converge downwards in the closed position, are opened by being pivoted upwards, and this results in a central, widening outflow opening.

The tobacco portions 18, which are released in a controlled manner from the chambers 31, 32, are intercepted in the region of the shaft 36 above the pressing chamber 35, in particular by (further) shutters 38, which are designed here in the same manner as the shutters 37, that is to say with a funnel-like cross-sectional profile and are preferably made up of two separately movable sub-shutters. The shutters are opened in a controlled manner in order for the tobacco portion to be fed under its own weight to the pressing chamber 35.

The special feature of the pressing subassembly resides in the fact that the portion 18 rests on a preferably obliquely oriented support during the pressing operation. A platform 39 is positioned in an oblique plane directed at an acute angle to the vertical plane, in particular approximately at 45°. A pressing plate 40 acts as the counter-mechanism to the platform 39 and can be moved, in particular pivoted, relative to the platform 39. The pressing plate 40, which in this case is designed in the manner of a segment, is mounted in a pivot bearing 41 beneath the shaft-like pressing chamber 35. The pivot bearing 41 is arranged directly adjacent to the platform 39, in which case a pressing surface of the pressing plate 40 and the platform 39 form a funnel-like bottom termination of the vertical shaft or the pressing chamber 35. The portion 18 is intercepted here. The pressing plate 40 is pivoted into a position in which the pressing surface is directed parallel to the platform 39. The tobacco portion 18 is compressed into a planar structure.

Figure 10:
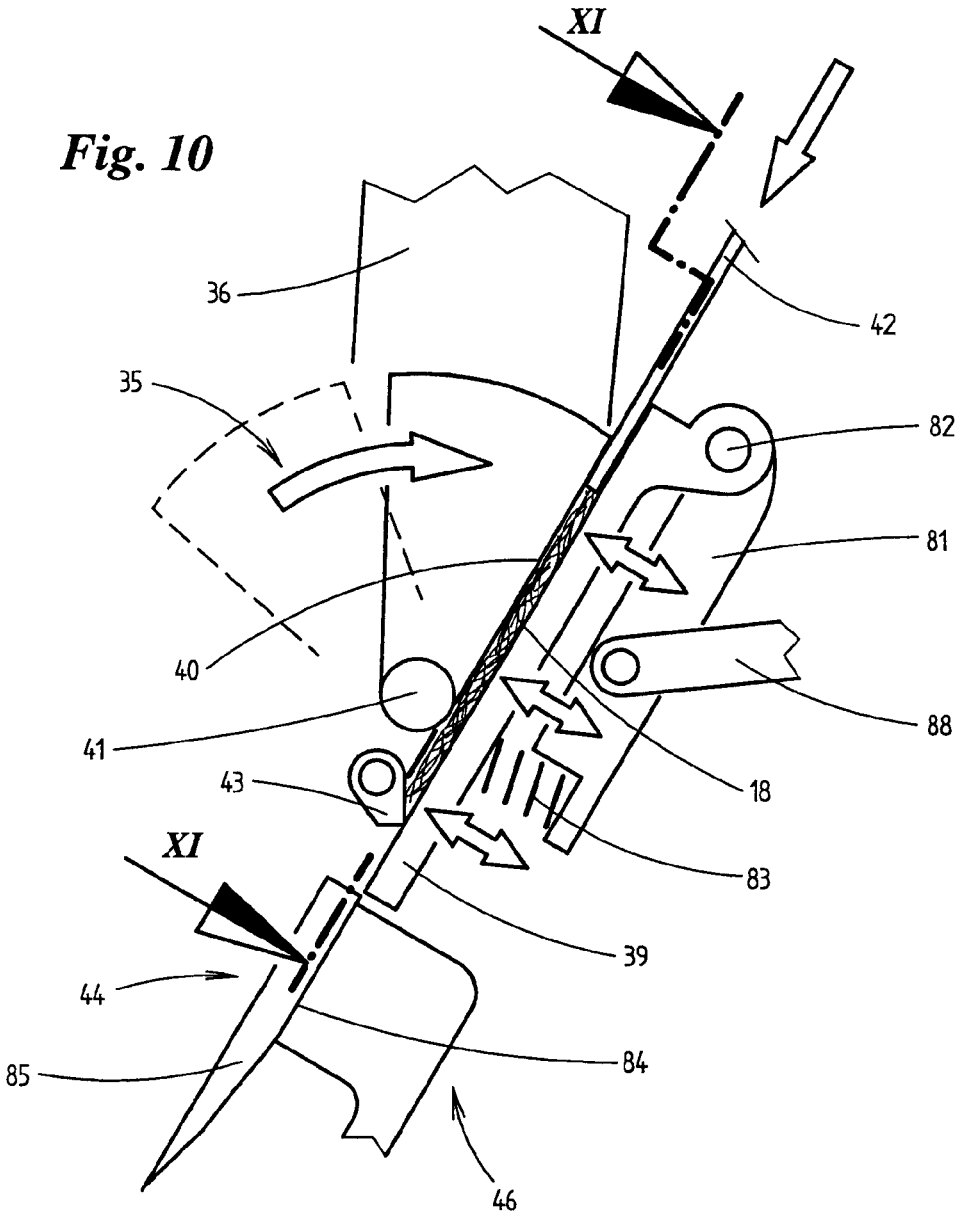
FIG. 10 shows, on an enlarged scale, a detail X of the unit according to FIG. 9, namely a pressing station in side view.
Figure 11:
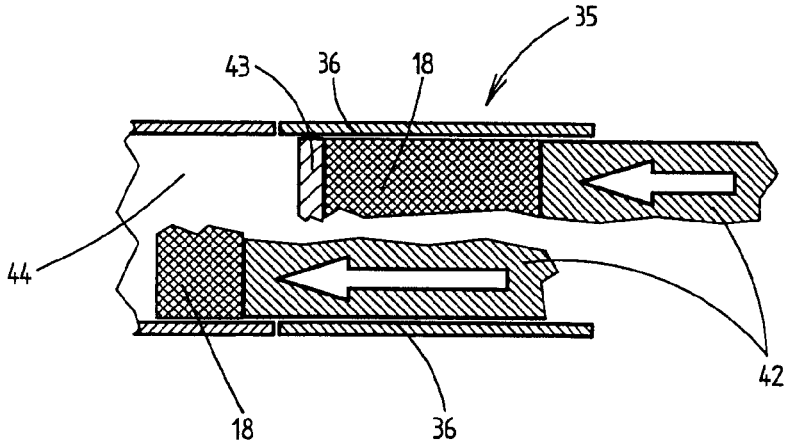
FIG. 11 shows a detail of the pressing station in plan view or along section plane XI-XI from FIG. 10.

The tobacco portion 18 is processed by further mechanisms for formatting purposes, that is to say it is subjected to pressure, preferably in the pressing position. In the case of the present exemplary embodiment, a further pressing mechanism or a plate-like pressing crosspiece 42 serves for transmitting transversely directed pressing forces to the tobacco portion 18. Located opposite the pressing crosspiece 42 is a counter-mechanism, in the present case a movable, in particular pivotable, closure crosspiece 43. This is mounted in a fixed location and, in the pressing position, projects, as a lateral boundary, into the region between the platform 39 and pressing plate 40 (FIG. 10). The tobacco portion 18 is forced against the closure crosspiece 43 by the pressing crosspiece 42, to be precise while the pressing plate 40 is in the pressing position. Accordingly, the pressing crosspiece 42 is moved between the pressing mechanisms 39, 40 in the obliquely directed pressing position in order to act on the tobacco portion 18 (FIG. 10).

Once the tobacco portion 18 has been pressed and formatted, it is transported away out of the region of the pressing chamber 35 and fed to the filling station 20 in immediate proximity. During this transfer, the rectangular, plate-like tobacco portion 18 is moved out of the (obliquely directed) pressing position into a position appropriate for the filling operation, in particular it is tilted into an upright filling position. A transfer mechanism for the tobacco portion 18 is provided in the form of an intermediate conveyor for this purpose. This transfer mechanism is a holder which is closed at least in the region of the large surface areas of the portion 18, in particular a portion pocket 44. In the accommodating position, this portion pocket is located adjacent to the pressing chamber 35, level with the platform 39, to be precise in an obliquely directed plane corresponding to the position of the pressing mechanisms 39, 40.

The pressed tobacco portion 18 is pushed, with the pressing form being maintained in the process, into the portion pocket 44, which is open at least on two mutually opposite sides. In the present case, the pressing crosspiece 42 acts, at the same time, as a pusher for the tobacco portion 18. Once the closure crosspiece 43 has been pivoted back, the tobacco portion 18 in this region is pushed out of the pressing region and into the directly adjacent portion pocket 44. The latter is also open on the side located opposite the pushing-in side, but is closed temporarily, in particular as the portion 18 is being pushed in, by a closure mechanism. In the present exemplary embodiment, this closure mechanism is of elastically movable and/or deformable design and is in the form of a closure plate 45, in particular one made of spring steel, which is fitted on the portion pocket 44 and/or on a carrying arm 46 of the portion pocket 44. The closure plate 45 is fitted, namely in an oblique position, such that, in the non-loaded starting position, it closes a bottom pushing-out opening of the portion pocket 44.

In particular with the closure plate 45 in the closed position, the portion pocket 44 is moved into the filling station 20, to be precise with the portion pocket 44 being erected such that the exit side is oriented downwards. On account of corresponding actuation of the carrying arm 46, the portion pocket 44 is moved along a path 79 which is illustrated by chain-dotted lines in FIG. 13. The portion pocket 44 is moved (along with the portion 18) first of all along a short rectilinear section in the plane of movement of the pusher or pressing crosspiece 42 following on from the pressing mechanisms 39, 40, then along an arcuate, downward directed part of the path, with the portion pocket being erected in the process, and finally, with a vertically downwardly directed movement, into the filling position. The relative positions of the mechanisms result in a very short transporting route and in an erecting movement along an acute angle. In the filling position, the portion pocket 44 has a bottom sub-region located in the pocket 11.

In order to provide the bag 10, the bag turret 23 is of polygonal design in cross section with planar turret walls 47. The bags 10, in particular four bags 10 one beside the other, are fixed on the turret walls 47. In the filling station 20, the turret wall 47, with the bags 10 which are to be filled, is located in an upright position.

For transfer of the portion 18 to the bag 10, an approximately plate-like pusher 48 which can be moved up and down enters into the portion pocket 44 via the upwardly directed open side and, by virtue of downward movement, pushes the portion 18 out of the portion pocket 44 into the pocket 11. The pusher 48 is approximately adapted, in respect of dimensions, to the cross section of the portion pocket 44, that is to say it is provided with a bottom crosspiece-like or head-like thickened portion 80. Following the pushing-in movement of the tobacco portion 18, the pusher 48 is retracted into a top, starting position. Furthermore, by virtue of the arm 46 being pivoted in the opposite direction, the portion pocket 44 returns into the starting position adjacent to the pressing chamber 35. The bag 10 is closed, in particular by virtue of a closure seam being provided in the region of the pocket opening 15. The fold-over flap 16 is then moved into the closed position and fixed.

Figure 13:
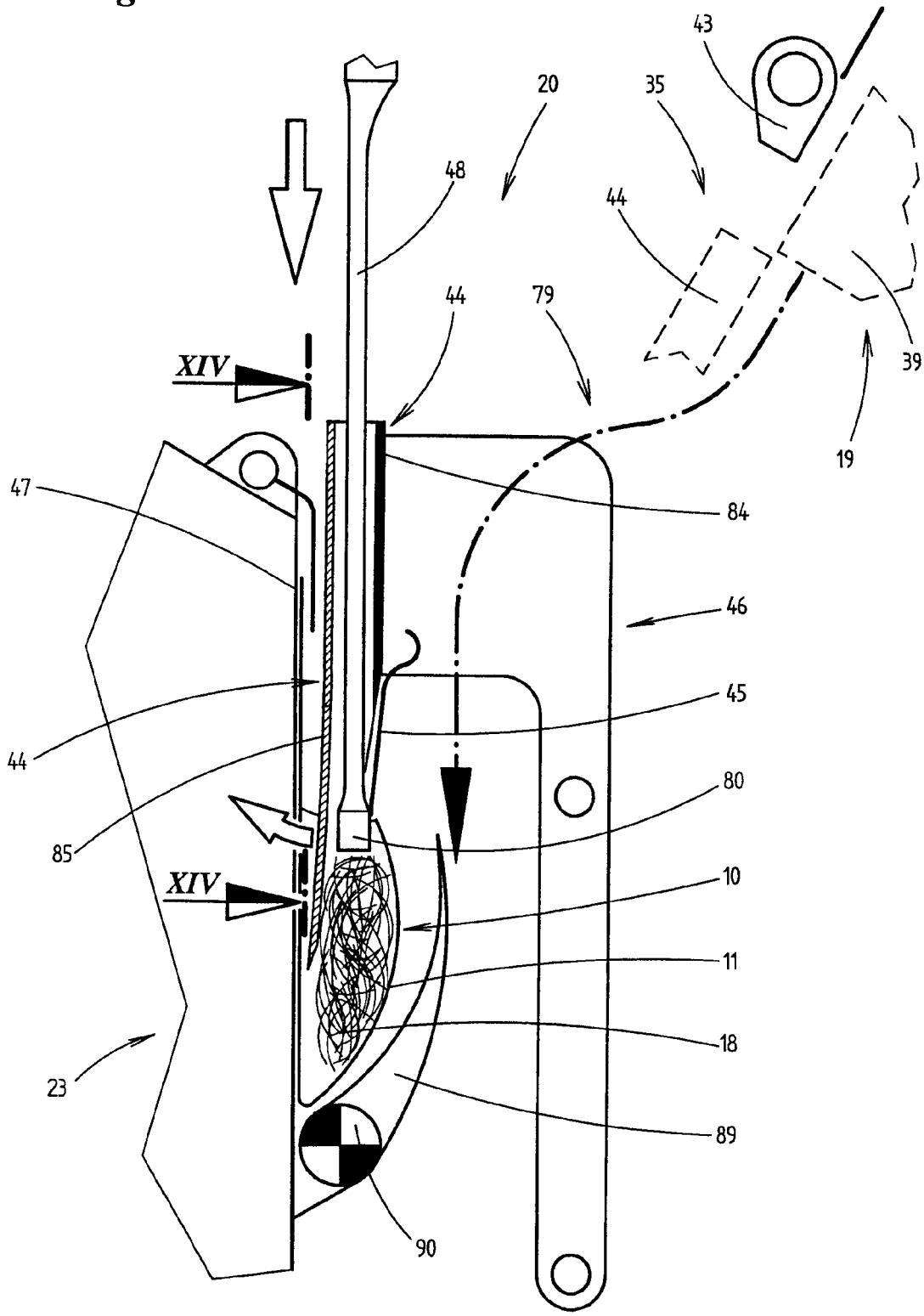
FIG. 13 shows, on an enlarged scale, details of the filling station in vertical section corresponding to XIII-XIII in FIG. 12.

The portion pocket 44 is designed in a particular manner. The closure mechanism, namely the closure plate 45, acts automatically. When the portion 18 is pushed out of the portion pocket 44, the closure plate 45 is forced out of the closure region by the pusher 48 or by the thickened portion 80 thereof (FIG. 13). The bottom exit opening of the portion pocket 44 is thus released. When the pusher 48 returns into the top, starting position, the facing side is cleaned, namely freed of tobacco residues, by virtue of the closure plate 45 butting against it.

Particular importance is afforded to the elastically compliant design and/or mounting of mechanisms which interact with the compressing operation and/or the pressed portion 18. The pressing mechanisms in the region of the pressing station 19 are mounted elastically. In the case of one exemplary embodiment (FIG. 10), the platform 39 is mounted pivotably on a carrier 81. A pivot bearing 82 is fitted at the periphery, in which case the platform 39 can be moved like a one-armed lever, that is to say relative to the carrier 81, to be precise counter to resilient pressure. In the present case, spring mounting is formed, by one or more compression springs 83, on the side located opposite the pivot bearing 82. Accordingly, if, in the pressing position (FIG. 10), the tobacco portion 18 is forced against the platform 39 by the pressing plate 40, the platform can yield slightly (millimeter range). This results in a homogeneous structure of the compressed portion 18. Furthermore, it facilitates the transversely directed compression of the portion 18 and, finally, the operation of pushing the latter off.

The portion pocket 44 is also of elastically compliant design. It comprises a rigid carrying wall 84, which in this case is a cross-sectionally U-shaped design and is fastened by lateral flanges on limbs of the carrying arm 46 (FIGS. 14 and 15). An elastically deformable covering wall 85 is arranged on the free side. This covering wall is connected at the periphery (in the top region) to the lateral limbs of the carrying wall 84 and/or to the carrying arm 46. The covering wall 85 is elastically deformable as a whole, that is to say it is of tonguelike design in the bottom region and, accordingly, can yield to the lateral pressure applied by the compressed portion 18 (FIGS. 13 and 15).

Figure 16:
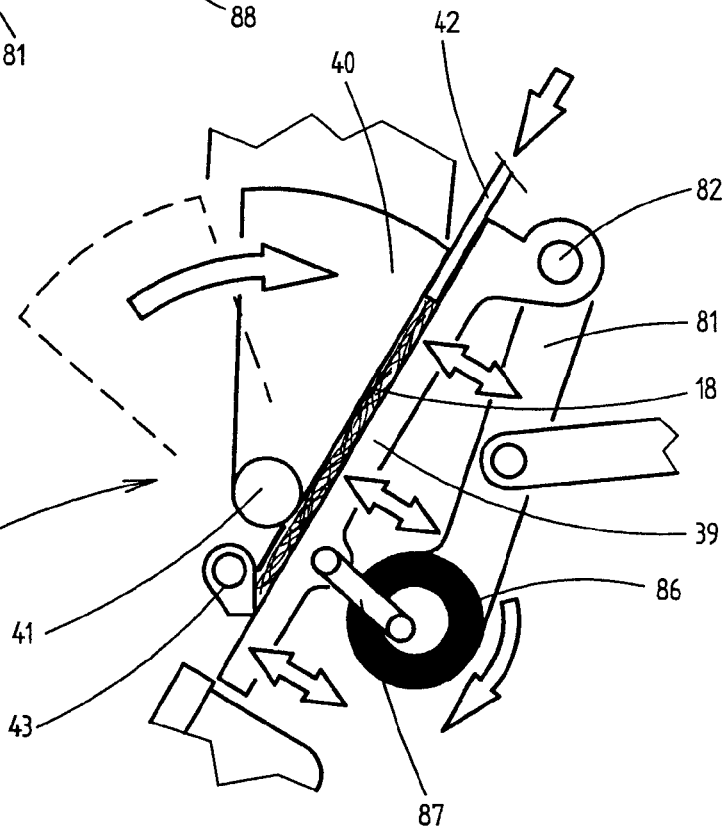
FIG. 16 shows a side view of a detail of a different embodiment of the pressing station.

As an alternative, or in addition, the elastically movable or deformable mechanisms may be driven to vibrate and/or oscillate. FIG. 16 shows an alternative to the configuration according to FIG. 10. The platform 39 is fitted in a pivotable manner on the carrier 81. The movable platform 39 is activated by a vibration mechanism, in this case by an (electric) motor 86 which is fitted on the carrier 81, is connected to the platform 39 via a mechanism, in this case via a connecting rod 87, and moves this platform to oscillate with a small amplitude. The vibration activation can be controlled such that the oscillations are generated during a phase in which the portion 18 is being compressed and/or during the pushing-out movement.

Figure 12:
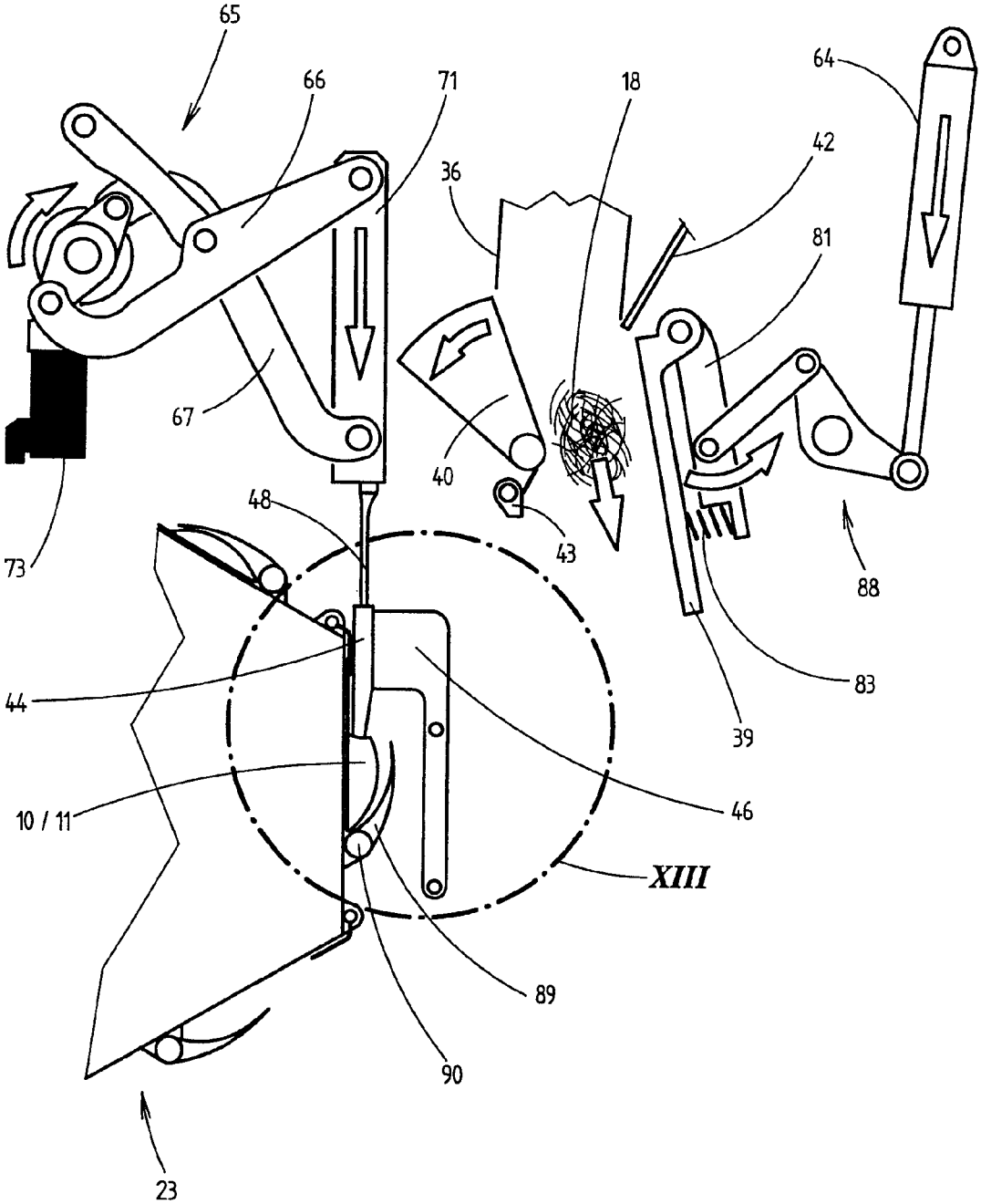
FIG. 12 shows a side view or vertical section of the pressing station and filling station in detail form, in different positions.

FIG. 12 shows a situation where there is no bag 10 to be filled in the region of the filling station 20, in this case on the bag turret 23. In this case, a control signal leads to the tobacco portion 18 being disposed of. According to FIG. 12, the tobacco portion 18 is removed from the pressing chamber 35, to be precise via the platform 39, which can be moved, in particular pivoted, downwards (with the carrier 81), in which case the (non-pressed) tobacco portion 18 drops downwards under its own weight.

Figure 17:
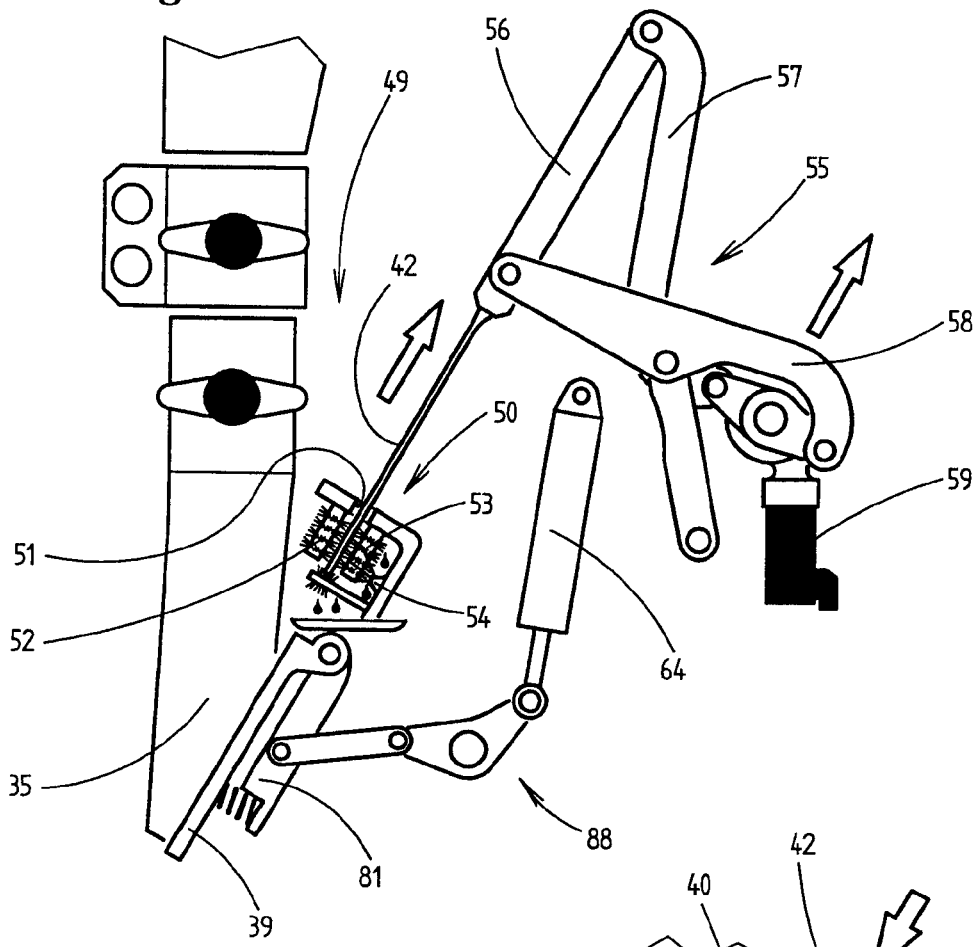
FIG. 17 shows a side view of the pressing station with pressing mechanisms in a cleaning position.

A further special feature is shown as an exemplary embodiment in FIG. 17. It is advantageous for mechanisms which are in contact with the tobacco to be cleaned from time to time. FIG. 17 uses the pressing crosspiece 42 to show an example of a mechanism being cleaned. The pressing crosspiece 42 can be moved, by a separate (cleaning) displacement, into a cleaning position, in which it is offset in relation to the pressing chamber 35. Cleaning mechanisms for the pressing crosspiece 42 are located here. A cleaning subassembly 49 has a retaining means for cleaning mechanisms and/or a cleaning housing 50. The mechanism which is to be cleaned can be introduced into the cleaning subassembly 49 via a (slot-like) opening 51. The interior of the cleaning subassembly contains brushes 52 which can be rotated about obliquely directed axes and are intended for the top side and underside of the pressing crosspiece 42. A further brush 53, which can be rotated about a transversely directed axis, serves for cleaning an end surface or pressing surface of the pressing crosspiece 42. In addition, or as an alternative, a cleaning agent or water is introduced into the cleaning subassembly and/or into the cleaning housing 50, to be precise by at least one nozzle 54 above the pressing crosspiece 42 in the cleaning position. The nozzle 54 sprays a liquid cleaning agent onto the articles which are to be cleaned and onto the cleaning mechanisms. A collecting pan is arranged beneath the cleaning subassembly.

Mechanisms of the pressing station 19 and/or of the filling station 20 can be moved by means of coupling mechanisms. Such a coupling mechanism, namely a pressing mechanism 55, serves for transmitting a back and forth linear movement of the pressing crosspiece 42. The latter is provided at the free end with a carrying component 56. The pressing mechanism 55 is connected to this carrying component 56, in the present case via two levers 57, 58. The mechanism 55 can be moved by a servomotor 59.

A (pneumatic) cylinder 64 is provided as an actuating mechanism in order to pivot the platform 39 and/or the carrier 81 for the purpose of disposing of portions 18 (12). This cylinder is connected to the carrier 81 via a pivoting mechanism 88.

The vertically movable pusher 48 of the filling unit 24 can be actuated by a pusher mechanism 65, which is designed in a manner analogous to the pressing mechanism 55. Levers 66, 67 of the pusher mechanism are connected to a carrying component 71 of the pusher 48. Here too, the movements are generated by a servomotor 73.

Figure 18:
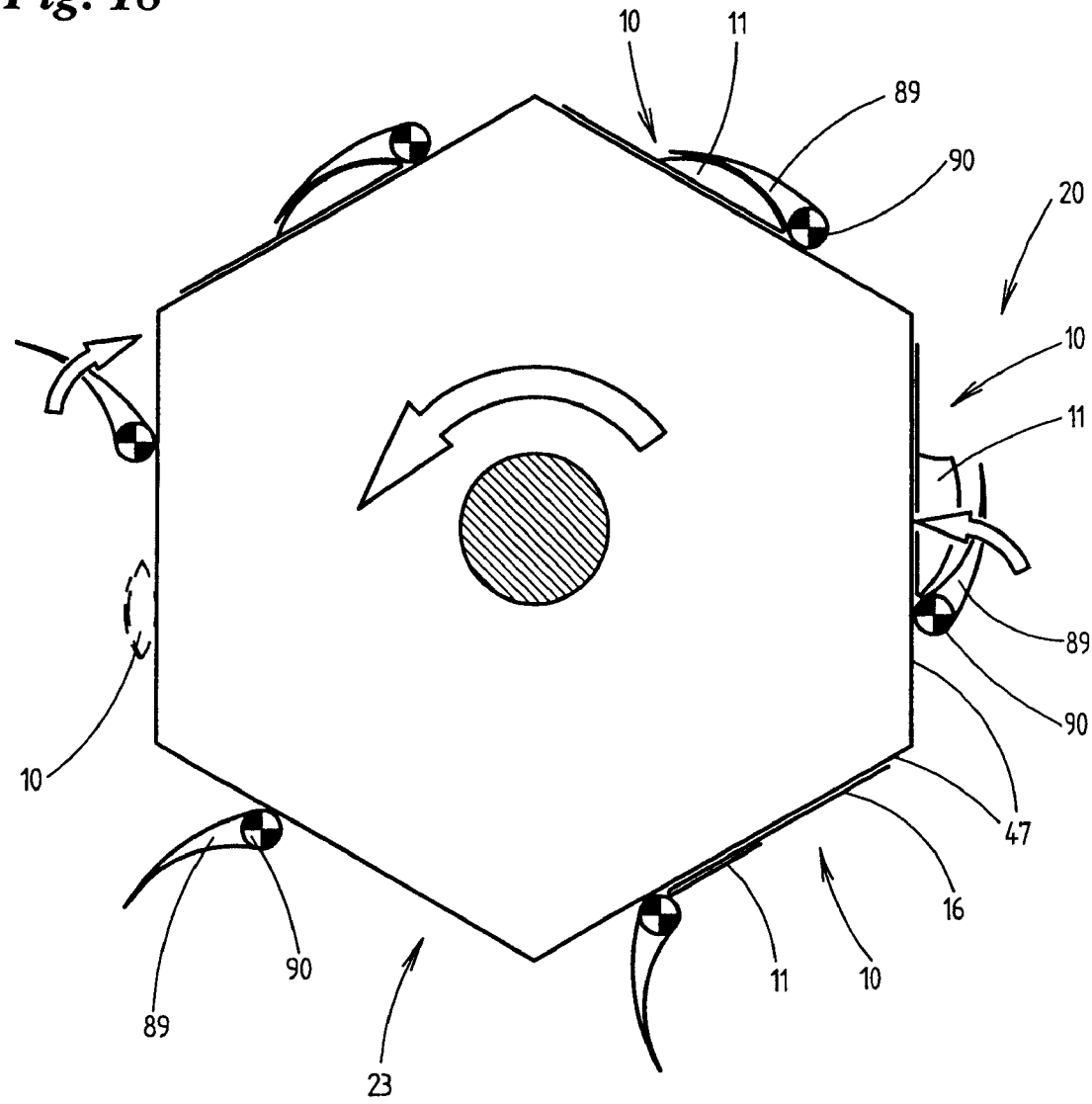
FIG. 18 shows a schematic vertical section, transverse to the axis, of a conveyor for empty and filled bags, namely a filling turret.

Retaining means for in each case one or more axially adjacent bags 10 are fitted on the circumference of the polygonal bag turret 23. These retaining means are retaining flaps 89 which are mounted in a pivotable manner in each case on a turret wall 47. The retaining flaps 89, which act as single-arm levers, can be pivoted, in each case by a drive shaft 90, out of a starting position, in which they are remote from the turret wall 47, until they butt against the bag 10, to be precise in the region of the pocket 11. The retaining flaps 89 are of arcuate design for adaptation to the curved outer contour of the (filled) pockets 11. It is also the case that the unfilled, empty bags 10 are retained in position flat against a respective turret wall 47 by the retaining flap 89 (FIG. 18).

The arcuate retaining flaps 89 also have the task of maintaining the pressing form of the portion 18 following introduction into the pocket 11. At least in the region of the filling station 20, the retaining flaps are therefore moved at elevated pressure against the front side of the pocket 11, with the portion 18 being compressed in the process. The retaining flaps 89 remain in the retaining and forming position on the outside of the pockets 11 throughout a number of stations of the bag turret 23, which is driven cyclically in rotation (in the anti-clockwise direction in FIG. 18).

The movement of the retaining flaps 89 is controlled mechanically. The bag turret 23 is assigned a more or less circular curved path 91. The latter is arranged in a fixed location concentrically with the axis of rotation of the bag turret 23. Guide rollers 92, which actuate a shaft lever 93, run in the curved path 91 along with the turret 28. This shaft lever is connected to the drive shaft 90 for the retaining flaps 89. The configuration of the curved path 91 results in the shaft levers 93 executing pivoting movements which are transmitted to the drive shaft 90 in order to move the retaining flaps 89 in accordance with FIG. 18.

Figure 20:
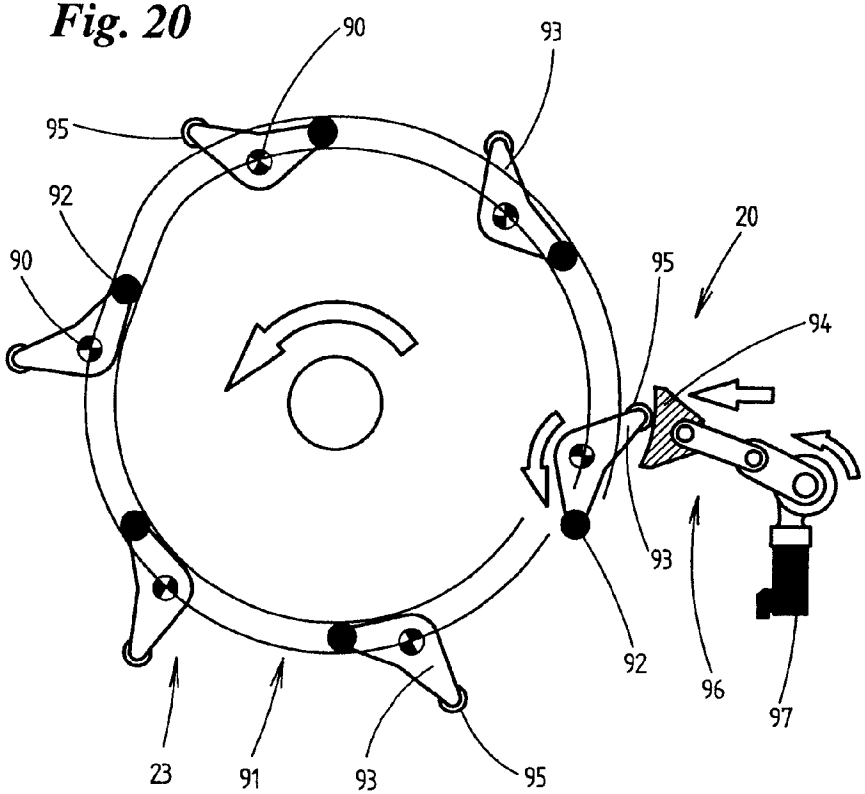
FIG. 20 shows the detail according to FIG. 19 with mechanisms in different positions.
Figure 19:
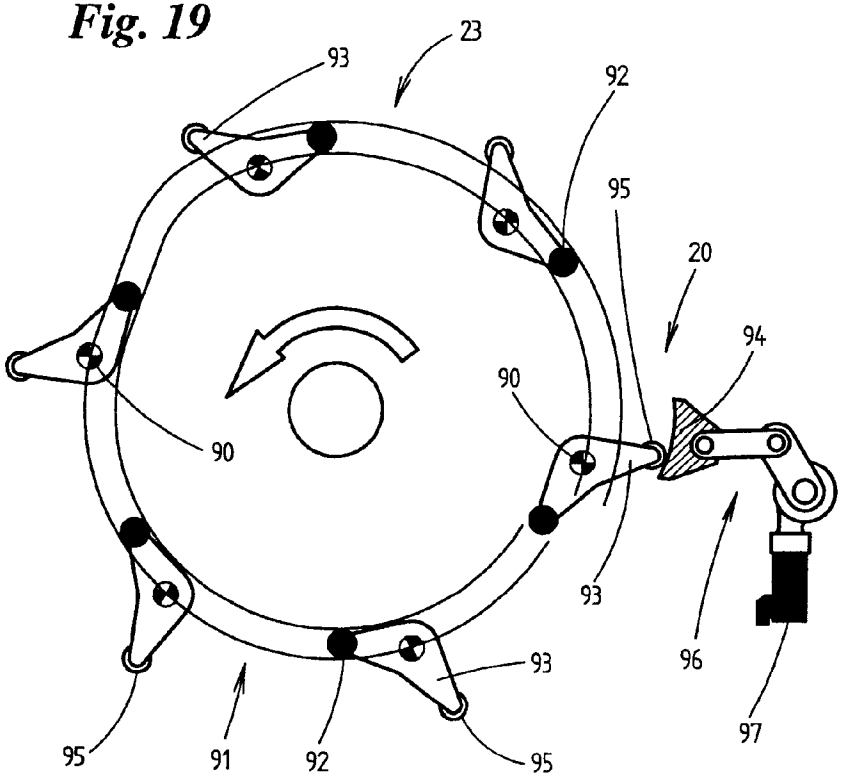
FIG. 19 shows details of a mechanical control means for mechanisms of the filling turret according to FIG. 18.

In the region of the filling station 20, elevated pressure is transmitted to the retaining flaps 89 in order to stabilize and shape the compressed tobacco portion 18 in the pocket 11. An additional actuating mechanism for the retaining flaps 89 is provided in this region of elevated pressure transmission. This actuating mechanism comprises a fixed-location pressure-exerting component 94 with a contoured, namely (approximately) circle-arc-shaped supporting surface. An extension is fitted on the shaft lever 93 or the shaft lever 93 is configured as a two-armed lever with a pressure-exerting roller 95 at the free end outside the region of the curved path 91. At least in the filling station 20, the pressure-exerting component 94 is active in order to transmit elevated pressure when a pivoting movement, and thus a relatively large torque, is generated in the region of the drive shaft 90. The pressure-exerting component 94 is mounted in a pivotable manner and can be driven by a servomotor 97 via a lever mechanism 96. The movement is controlled such that the pressure-exerting component 94 transmits a rotary movement in the anti-clockwise direction (in the case of the present exemplary embodiment) to the drive shaft 90 (FIG. 20). The pressure-exerting component 94 then returns into a position which ensures that the guide roller 92 assumes guiding and torque-generating functions. The curved path 91, in this region, has an interruption 98 in order that the shaft lever 93 can be moved freely during this phase, that is to say only on account of actuation by the pressure-exerting component 94. On account of the relative positioning of the same following pressure activation, the guide roller 92 enters into an open end of the curved path 91 again.

LIST OF DESIGNATIONS

10 bag
11 pocket
12 front wall
13 rear wall
14 side seam
15 pocket opening
16 fold-over flap
17 tape
18 tobacco portion
19 pressing station
20 filling station
21 production unit
22 transfer unit
23 bag turret
24 filling unit
25 sheet-material web
26 removal conveyor
27 collecting subassembly
28 bucket chain
29 bucket
30 transverse slide
31 chamber
32 chamber
33 crank drive
34 hopper
35 pressing chamber
36 shaft
37 shutter
38 shutter
39 platform
40 pressing plate
41 pivot bearing
42 pressing crosspiece
43 closure crosspiece
44 portion pocket
45 closure plate
46 carrying arm
47 turret wall
48 pusher
49 cleaning subassembly
50 cleaning housing
51 opening
52 brush
53 brush
54 nozzle
55 pressing mechanism
56 carrying component
57 lever
58 lever
59 servomotor
64 cylinder
65 pusher mechanism
66 lever
67 lever
71 carrying component
73 servomotor
74 guide rod
75 drive motor
76 servomotor
77 servomotor
78 connecting bridge
79 path
80 thickened portion
81 carrier
82 pivot bearing
83 compression spring
84 carrying walls
85 covering wall
86 motor
87 connecting rod
88 pivoting mechanism
89 retaining flap
90 drive shaft
91 curved path
92 guide roller
93 shaft lever
94 pressure-exerting component
95 pressure-exerting roller
96 lever mechanism
97 servomotor
98 interruption

What is claimed is:

1. A method for introducing tobacco portions (18) into a sheet-material bag (10), which is fed in succession to a filling station (20) by a turret (23) conveying element with the portion (18) being compressed by interacting pressing mechanisms (39, 40, 42) in a pressing chamber (35) of a pressing station (19), and then introduced into the bag (10) with a pressing form being maintained, comprising:

a) pressing the portion (18) on a stationary platform (39) that is obliquely oriented at an acute angle, by means of a pivotable pressing plate (40), the pressing chamber (35) comprising the platform (39) and the pressing plate (40), wherein in a pressing position the pressing plate (40) is positioned in an oblique position adjacent to the platform (39) thus forming the pressing chamber (35);

b) in the pressing position of the platform (39) and the pressing plate (40), displacing a pressing crosspiece (42) between the pressing platform (39) and the pressing plate (40), wherein the portion (18) is pressed transversely;

c) through continued movement of the pressing crosspiece (42), pushing the portion (18) out of the pressing chamber (35) while the pressing chamber (35) is open and while maintaining the pressing position and inserting the portion (18) into a portion pocket in an oblique position adjacent the pressing chamber (44) immediately following the pressing chamber (35);

d) pivoting the portion pocket (44) out of the oblique position in the region of the pressing chamber (35) and moving the portion pocket (44) into an upright position in the filling station (20) above the bag (10);

e) moving a pusher (48) downward from an upper initial position and inserting the pusher (48) into the portion pocket (44), moving the pusher (48) through the portion pocket (44) thereby moving the portion (18), and introducing the portion (18) into the bag (10) below the portion pocket (44); and f) returning the pusher (48) to the upper initial position by an upward movement, and after the pusher (48) has returned to the upper initial position, pivoting the portion pocket (44) in an opposite direction into the receiving position adjacent to the pressing chamber (35).

2. The method according to claim 1, wherein the platform (39), as part of the pressing chamber (35), oscillate or vibrate by means of a vibration generator (86, 87) at least during the pressing operation and/or as the portion (18) is being pushed out of the pressing chamber (35).

3. The method according to claim 1 or 2, wherein the platform (39), as part of the pressing chamber (35), is mounted in an elastically movable manner on a stationary carrier (81) by supporting the platform (39) with compression springs on the carrier (81).

4. The method according to claim 1, further comprising moving the platform (39) and/or the pressing plate (40) out of the pressing position such that a faulty portion (18) in the region of the pressing station (19) is discharged downwards under its own weight without being pressed.

5. The method according to claim 1, further comprising moving the crosspiece (42) into a retracted cleaning position in which movable brushes (52, 53) or rotating brush rollers, as mechanical cleaning mechanisms, act in a cleaning manner on the pressing crosspiece (42).

6. The method according to claim 1, wherein the portion pocket (44) has, on an exit side for the portion (18), a closure plate (45) as a closure means, and further comprising moving, for discharging the portion (18) from the portion pocket (44), the closure plate (45) out of a closed position.

7. An apparatus for introducing tobacco portions (18) into a sheet-material bag (10), which are fed in succession to a filling station (20) by a turret (23) conveying element, with the portions (18) being compressed by interacting pressing mechanisms (39, 40, 42) in a pressing chamber (35) of a pressing station (19) and being introduced into the bag (10), with a pressing form being maintained in the process, comprising:

a) planar pressing mechanisms for compressing the portion (18) in the pressing station (19), the portion (18) being compressed between the planar pressing mechanisms, the pressing chamber (35) comprising the planar pressing mechanisms, and the planar pressing mechanisms being a stationary platform (39) and a pivotable pressing plate (40), wherein the platform (39) is obliquely oriented at an acute angle and the pressing plate (40) is in an oblique position adjacent to the platform (39) when in a pressing position for forming the pressing chamber (35);

b) a pressing crosspiece (42), which is displaced between the platform (39) and the pressing plate (40) when the platform (39) and the pressing plate (40) are in the pressing position, wherein the portion (18) is pressed transversely between the platform (39) and the pressing plate (40) by the pressing crosspiece (42), then is pushed out of the pressing position between the pressing mechanisms (39, 40), and then is fed to an intermediate conveyor with a portion pocket (44) for accommodating the portion (18), and through continued movement of the pressing crosspiece (42), the portion (18) is pushed out of the pressing chamber (35) while the pressing chamber (35) is open and while maintaining the pressing position and the portion (18) is inserted into the portion pocket (44) immediately following the pressing chamber (35);

c) a means for pivoting the portion pocket (44) out of an oblique position and into an upright position in the filling station (20) above the bag (10);

d) a pusher (48), which is movable downwards from an upper initial position and is insertable in the pocket portion (44) and is movable through the pocket portion (44) thereby moving the portion (18) and pushing the portion (18) into the bag (10) below the portion pocket (14), wherein after the pusher (48) returns to the upper initial position by an upward movement, the portion pocket (44) is pivotable in an opposite direction into a receiving position adjacent to the pressing chamber (35).

8. The apparatus according to claim 7, further comprising compression springs (83) on a stationary carrier (81), wherein the platform (39), as part of the pressing chamber (35), is mounted in an elastically movable manner on the carrier (81) by the compression springs (83).

9. The apparatus according to claim 8, further comprising a vibration generator, wherein the platform (39), as part of the pressing chamber (35), is vibrated or oscillated by the vibration generator (86, 87) at least during the pressing operation and/or as the portion (18) is being pushed out of the pressing chamber (35).

10. The apparatus according to claim 7, wherein the platform (39) and/or the pressing plate (40) is movable out of the pressing position such that a faulty portion (18) in the region of the pressing station (19) is dischargeable downwards under its own weight without being pressed.

11. The apparatus according to claim 7, wherein, on an exit side for the portion (18), the portion pocket (44) has a closure plate (45) as a closure means which, for discharge of the portion (18) from the portion pocket (44), is movable out of a closed position by the pusher (48).

12. The apparatus according to claim 7, further comprising a collecting subassembly (27) for the portions (18), wherein:

the portions (18) fed by a conveyor (28) to the collecting subassembly (27), with the collecting subassembly (27) being arranged above shafts (36) assigned to the pressing chambers (35);

the collecting subassembly (27) comprises a transversely movable slide (30) with a plurality of chambers (31, 32) for holding a respective one of the portions (18), with one of the plurality of chambers (31, 32) being assigned to each of the shafts (36); and each of the chambers (31, 32) comprises a controllable shutter (37) having sub-shutters, which are employed for temporary accommodation of the portion (18) and which release the portion (18) in a controlled manner for introduction of the portion (18) into the shaft (36) associated with the chamber (31, 32).

13. The apparatus according to claim 12, wherein, by virtue of relative positioning being changed as a result of transverse movement, the chambers (31, 32) of the transverse slide (30) are filled with the portions (18) one after the other by the feed conveyor and the shutters (37) are moved jointly into the open position when all the chambers (31, 32) have the portion (18).

14. The apparatus according to claim 7, further comprising mechanical cleaning mechanisms, wherein the pressing crosspiece (42) is movable into a retracted cleaning position in which the mechanical cleaning mechanisms, having movable brushes (52, 53) or rotating brush rollers, act in a cleaning manner on the pressing crosspiece (42), in conjunction with a cleaning agent which is fed by at least one nozzle (54).

15. The apparatus according to claim 5, wherein the turret 23 transports a plurality of the bags (10) that are arranged adjacent to one another into the filling station (20).

16. The apparatus according to claim 15, wherein the turret (23) is rotatable around a horizontal axis and the bags (10) are held ready in the filling station (20) and are at the same time arranged adjacent to one another along a circumference of the turret (23) in an axial direction.

* * * * *